US006148743A

United States Patent [19]

Vatsky

[11] Patent Number: 6,148,743

[45] **Date of Patent: *Nov. 21, 2000**

[54] AIR NOZZLE FOR A FURNACE

[75] Inventor: Joel Vatsky, West Orange, N.J.

[73] Assignee: Foster Wheeler Corporation, Clinton, N.J.

[ * ] Notice: This patent is subject to a terminal disclaimer.

[21] Appl. No.: 08/641,021

[22] Filed: Apr. 29, 1996

[51] Int. Cl.[7] ..... B05B 1/26; B05B 15/08; F23L 13/00

[52] U.S. Cl. ..... 110/297; 431/10; 239/507; 239/513; 239/587.6; 110/264

[58] Field of Search ..... 110/182.5, 297, 110/347, 345, 263, 264, 265; 431/8, 10, 174; 239/587.5, 587.6, 507, 509, 513, 587.1

[56] References Cited

U.S. PATENT DOCUMENTS

| | | | |
|---|---|---|---|
| 2,111,611 | 3/1938 | Brenner | 110/297 |
| 2,801,133 | 7/1957 | Ridley | 239/591 |
| 3,224,419 | 12/1965 | Lowenstein et al. | 122/478 |
| 3,281,082 | 10/1966 | Kerry | 239/265.35 |
| 3,580,512 | 5/1971 | Smith et al. | 239/432 |
| 4,150,631 | 4/1979 | Frey et al. | 110/186 |
| 4,387,914 | 6/1983 | Paulson et al. | 285/119 |
| 4,400,151 | 8/1983 | Vatsky | 431/184 |
| 4,412,496 | 11/1983 | Trozzi | 110/347 |
| 4,425,855 | 1/1984 | Chadshay | 110/263 |
| 4,434,727 | 3/1984 | McCartney | 110/347 |
| 4,480,558 | 11/1984 | Russell | 110/297 |
| 4,520,739 | 6/1985 | McCartney et al. | 110/263 |
| 4,570,533 | 2/1986 | Sugawara et al. | 454/319 |
| 4,699,322 | 10/1987 | Jobst | 239/503 |
| 5,001,992 | 3/1991 | Higgins et al. | 110/182.5 |
| 5,020,454 | 6/1991 | Hellewell et al. | 110/264 |
| 5,060,984 | 10/1991 | Hess | 285/127 |
| 5,211,705 | 5/1993 | Hagar | 431/10 |
| 5,329,866 | 7/1994 | LaRue | 110/265 |
| 5,435,492 | 7/1995 | Tenerowicz | 239/587.6 |
| 5,450,803 | 9/1995 | Svensk et al. | 110/346 |
| 5,461,990 | 10/1995 | Newman | 110/261 |
| 5,662,464 | 9/1997 | LaRose et al. | 431/8 |
| 5,746,143 | 5/1998 | Vatsky | 110/297 |
| 6,003,793 | 12/1999 | Mann | 239/587.5 |

FOREIGN PATENT DOCUMENTS

| | | |
|---|---|---|
| 586285 | 3/1947 | United Kingdom . |

*Primary Examiner*—Ira S. Lazarus
*Assistant Examiner*—Ljiljana V. Ciric
*Attorney, Agent, or Firm*—Haynes and Boone, LLP

[57] ABSTRACT

An air nozzle for introducing secondary air into a furnace and including a housing provided with an inlet at one end thereof for receiving air and an outlet at the other end thereof for discharging the air. A damper is disposed in the housing in the path of the air for splitting the flow of the air into two flow streams which extend to different areas of the furnace and is adapted for pivotal movement in the housing to vary the amount of air flow in each of the streams and the discharge angle of one of the streams.

3 Claims, 1 Drawing Sheet

AIR NOZZLE FOR A FURNACE

FIELD OF THE INVENTION

This invention relates generally to an air nozzle for use in a coal-fired furnace and, more particularly, to such an air nozzle for discharging air into the interior of the furnace to support the combustion of coal discharged from a burner.

In coal fired furnace systems, a mixture of coal and air is usually discharged from one or more burners mounted relative to a furnace wall or walls, and secondary air is discharged from one or more air nozzles located adjacent each burner. Many types, arrangements and locations of the burners and the secondary air nozzles have been used. For example, in a conventional, straight firing system, the air nozzles are mounted relative to the furnace walls adjacent their associated burners in a manner to discharge the secondary air in a direction perpendicular to the walls. In tangential firing systems, the burners and the secondary air nozzles are disposed in each of the corners of the furnace and are designed specifically to discharge the fuel and the secondary air, respectively, towards an imaginary circle located in the center of the furnace. However, in these tangential firing arrangements, although a reducing atmosphere is often present along the inner surfaces of the boundary walls which causes corrosion and slagging, there is no provision for directing air from the air nozzles to the boundary walls. Therefore, what is needed is a secondary air nozzle for use in a tangentially fired furnace in which the nozzle directs secondary air both towards the center of the furnace to support the combustion of the fuel, and towards a furnace boundary wall to minimize corrosion and slagging.

SUMMARY OF THE INVENTION

The secondary air nozzle of the present invention is designed for use in furnace applications in which improvements are achieved by discharging the secondary air in two distinct flow patterns. To this end, the nozzle is provided with a damper blade that splits the air flow into two distinct discharge flow streams, which are directed into different areas of the interior of the furnace. The discharge pattern from the nozzle can be adjusted in accordance with the particular nozzle location and design requirements. When used with a tangentially fired furnace, one of the air flow streams is directed towards the center of the furnace in a combustion-supporting relationship to the fuel, and the other air flow stream is directed towards the inner surface of one of the boundary walls to maintain an oxidizing atmosphere along the inner surfaces of the furnace wall.

Thus, significant advantages are achieved with the secondary air nozzle of the present invention since it provides two distinct discharge streams for the secondary air, with the relative amount of air and the angle of discharge being variable.

DESCRIPTION OF THE PREFERRED EMBODIMENT

Figure 1:
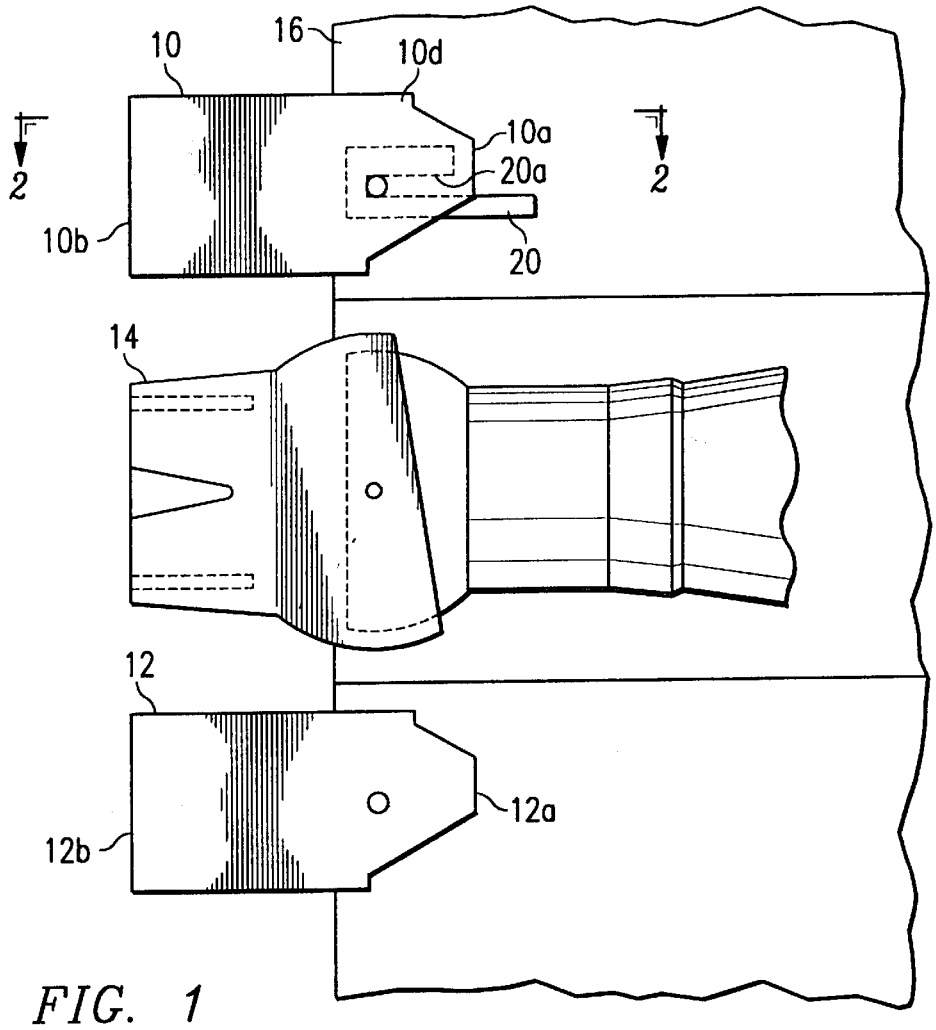
FIG. 1 is a side view of two air discharge devices of the present invention shown respectively mounted above and below a coal nozzle.
Figure 2:
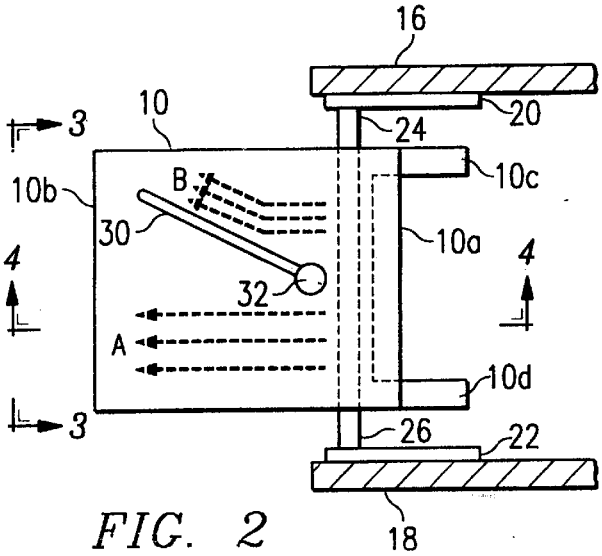
FIG. 2 is a cross-sectional view taken along the line 2—2 of FIG. 1.
Figure 3:
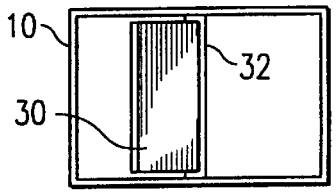
FIG. 3 is a cross-sectional view taken along the line 3—3 of FIG. 2.

Referring to FIG. 1 of the drawings, a pair of air discharge nozzles 10 and 12 are provided, with the nozzle 10 extending immediately above a coal discharge nozzle 14, and the nozzle 12 extending immediately below the nozzle 14. As shown in FIG. 2, each discharge nozzle 10 and 12 is formed by a housing having a rectangular cross section, with the end portions 10 and 12*a* of the nozzles 10 and 12, respectively, being open to receive air, and with their other end portions 10*b* and 12*b* also being open to discharge the air, as will be further described.

The nozzles 10, 12 and 14 are mounted between two spaced mounting walls 16 and 18 (FIG. 2) which, in turn, are installed relative to one or more walls (not shown) of a furnace. For example, the mounting walls 16 and 18 can be installed in the corners of a furnace whose walls are formed by a plurality of water tubes connected by continuous elongated fins, as shown and described in U.S. patent application Ser. No. 08/595,900 filed Feb. 6, 1996 the disclosure of which is incorporated by reference.

The air nozzle 10 is shown in detail in FIGS. 2–5. A pair of U-shaped mounting plates 20 (FIGS. 1 and 2) and 22 (FIG. 2) are secured to the walls 16 and 18, respectively, in any known manner for pivotally mounting the air 20*a* (FIG. 1) is provided in the plate 20, it being understood that a similar slot (not shown) is formed in the plate 22. As shown in FIG. 2, a pair of mounting shafts 24 and 26 project from the respective side walls of the housing of the nozzle 10 and into the slot 20*a* and the slot associated with the plate 22, respectively. Thus, the nozzle 10 is mounted for pivotal movement about an axis defined by the shafts 24 and 26. (Alternatively, as shown by the dashed lines in FIG. 2, a single mounting shaft can extend through the housing with its respective end portions projecting from the housing and extending in the slot 20*a* and the slot associated with the plate 22). This pivotal movement causes the discharge end portion 10*b* of the nozzle 10 to tilt upwardly and downwardly (as viewed in FIG. 1) relative to the walls 16 and 18, as will be described.

A pair of lobes 10*c* and 10*d* (FIG. 2) are formed at the end portion 10*a* of the housing of the nozzle 10, and are for the purpose of connecting the nozzle 10 to a linkage and drive mechanism (not shown) for selectively pivoting the nozzle about the axis defined by the shafts 24 and 26 in the above manner. This linkage and drive mechanism is fully disclosed in application Ser. No. 288,863 filed on Aug. 11, 1994, now U.S. Pat. No. 5,461,990 and assigned to the present invention, the disclosure of which is incorporated by reference. Since this linkage and drive mechanism does not, per se, form a part of the present invention a detailed disclosure of same has not been included for the convenience of presentation.

The above-described pivotal movement of the nozzle 10 enables the discharge angle of the air discharging from the end portion 10*b* of the nozzle 10 to be varied. The U-shaped slot 20*a* and the corresponding slot in the mounting plate 22 also accommodate axial movement of the nozzle 10 relative to the mounting walls 16 and 18 to accommodate differential thermal expansion between the nozzle and the walls.

Figure 4:
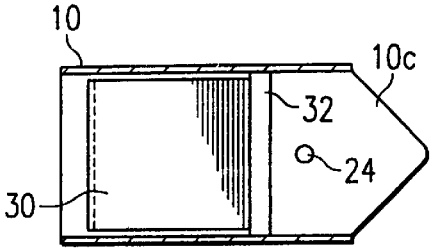
FIG. 4 is a cross-sectional view taken along the line 4—4 of FIG. 2.

With reference to FIGS. 2–5, a damper blade 30 is disposed in the housing of the nozzle 10 and is secured in any known manner to a shaft 32 which extends from the upper wall of the nozzle housing to the lower wall thereof as better shown in FIG. 4. The blade 30 thus splits the air entering the housing into two streams-one directed generally towards the center of the interior of the furnace as shown by the flow arrows A, and the other directed at an angle to the flow stream A and towards an extension of the adjacent mounting wall 16, as shown by the flow arrows B. In applications where the air nozzles 10 and 12 and the fuel nozzle 14 are mounted in the corners of a tangentially-fired furnace as disclosed in the above-identified patent application Ser. No. 08/595,900, the flow stream B would pass along the furnace wall associated with, or adjacent to, the mounting wall 16.

The shaft 32 is rotatably mounted relative to the walls of the housing of the nozzle 10 in any known manner such as, for example, providing journals, bearings, or the like (not shown), in the latter walls. Thus, rotation of the shaft 32 causes corresponding pivotal movement of the blade 30 to vary the quantity, or mass flow, of the air in each of the respective flow streams A and B and the discharge angle of the flow stream B. The latter angle thus varies in a plane perpendicular to the plane in which the discharge angle varies as a result of the tilting of the nozzle, as described above.

It is understood that the blade 30 and be positioned manually by simply pivoting the blade to the desired position or, alternatively, a drive motor, or the like (not shown) can be coupled to the shaft 32 to rotate the shaft in a conventional manner to pivot the blade accordingly.

Since the nozzle 12 is identical in structure and function to the nozzle 10, including the inclusion of a blade identical to the blade 30, the nozzle 12 will not be described in detail. Also, since the present invention does not include the burner 14 per se, the latter will also not be described in detail, especially since it is also fully disclosed in the above-identified application.

In operation, a fuel/air mixture is introduced to, and discharged from, the burner 14 in a general direction towards the center of the furnace. Air is introduced into the air nozzles 10 and 12 and the damper 30 in each nozzle functions to split the air into the flow streams A and B which pass into the interior of the furnace. Each flow stream A from the nozzles 12 and 14 discharges in a flow stream directed generally towards the center of the furnace interior in the same general pattern as that of the fuel/air mixture discharging from the burner 14. Each flow stream B from each nozzle 10 and 12 discharges at an angle to the axis of the nozzle and towards an extension of the mounting wall 16 which, in applications where the nozzles 10 and 12 and the burner 14 are mounted in a corner of the furnace, would be along the furnace wall extending from, or adjacent to, the wall 16. Rotation of the shaft 32 of each nozzle 10 and 12 causes corresponding pivotal movement of its corresponding blade 30 which varies the relatively quantities, or mass flow, of the air in the flow streams A and B and the discharge angle of the flow stream B.

The above-mentioned linkage and drive mechanism is also activated to cause a pivotal, or tilting, movement of the nozzles 10 and 12, about a horizontal axis perpendicular to the axis defined by the shafts 24 and 26 to vary the vertical location of the flow streams A and B in the furnace. It is understood that the discharge end of the burner nozzle 14 can also be tilted in the manner described in the above-identified patent application Ser. No. 288,863 filed on Aug. 11, 1994, now U.S. Pat. No. 5,461,990, and assigned to the assignee of the prevent invention Thus, the flow streams A and B from each nozzle as well as the respective air mass flows from each nozzle 10 and 12 can be precisely controlled in accordance with particular design requirements.

It is understood that several variations may be made in the foregoing without departing from the scope of the present invention. For example, the shaft 32 may be rigidly mounted in the housing of the nozzles 10 and 12 and the blade 30 pivotally mounted relative to the shaft. Also, the air nozzles 10 and 12 of the present invention are not limited to use with any specific coal-fired furnace or burner, but rather can be used in other environments requiring the variable air discharge patterns discussed above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. In combination, a furnace comprising at least one wall; and an air nozzle comprising a housing having an inlet for receiving air and an outlet for discharging the air, a mounting member for mounting the housing to the at least one wall of the furnace for pivotal movement about a first axis to vary the air discharge pattern from the outlet so that the air is discharged into the interior of the furnace in a variable discharge pattern, and a damper blade mounted in the housing about a second axis extending transversely to the first axis for splitting the discharging air into two streams.

2. The nozzle of claim 1 wherein the damper blade is pivotally mounted in the housing about the second axis to vary the flow of the streams.

3. The nozzle of claim 2 wherein the mounting member comprises a shaft extending through an opening in the housing for permitting the pivotal movement of the housing.

* * * * *

UNITED STATES PATENT AND TRADEMARK OFFICE

CERTIFICATE OF CORRECTION

PATENT NO. : 6,148,743
DATED : November 21, 2000
INVENTOR(S) : Joel Vatsky

It is certified that error appears in the above-identified patent and that said Letters Patent is hereby corrected as shown below:

Title page,
Change the title to read as follows: -- AN AIR NOZZLE FOR A FURNACE --

Column 2,
Lines 5, delete "10" and replace with -- 10a --
Line 21, delete "any known manner for pivotally mounting the air 20a (FIG." and replace with -- any known manner for pivotally mounting the air nozzle 10 relative to the latter walls. To this end, an elongated, U-shaped slot 20a (FIG. --

Signed and Sealed this

Twenty-third Day of April, 2002

*Attest:*

*Attesting Officer*

JAMES E. ROGAN
*Director of the United States Patent and Trademark Office*